US005094365A

United States Patent [19]

Dorfman

[11] Patent Number: 5,094,365

[45] Date of Patent: Mar. 10, 1992

[54] ADAPTER FOR USE IN TAPPING A CONTAINER

[75] Inventor: Jan L. Dorfman, Littleton, Colo.

[73] Assignee: Coors Brewing Company, Golden, Colo.

[21] Appl. No.: 560,160

[22] Filed: Jul. 31, 1990

[51] Int. Cl.[5] ..... B67D 5/00

[52] U.S. Cl. ..... 222/400.7; 222/399; 137/212

[58] Field of Search ..... 222/400.8, 400.7, 400.5, 222/399; 220/233, 234, 360; 215/3, 248, 311; 137/212

[56] References Cited

U.S. PATENT DOCUMENTS

| | | | |
|---|---|---|---|
| 2,312,067 | 2/1943 | Bates | 222/400.8 |
| 3,228,413 | 1/1966 | Stevens, Jr. | 222/400.7 |
| 4,000,829 | 1/1977 | Johnson, Jr. et al. | 220/265 |
| 4,436,227 | 3/1984 | Johnson, Jr. et al. | 222/382 |
| 4,436,228 | 3/1984 | Frey | 222/400.7 |
| 4,520,954 | 6/1985 | Brown | 222/400.8 |
| 4,665,940 | 5/1987 | Jacobson | 137/212 |
| 4,699,298 | 10/1987 | Grant et al. | 222/400.7 |
| 4,706,847 | 11/1987 | Sankey et al. | 222/400.7 |
| 4,717,048 | 1/1988 | Stenger | 222/400.8 |
| 4,784,299 | 11/1988 | Stenger | 222/397 |

FOREIGN PATENT DOCUMENTS

| | | | |
|---|---|---|---|
| 0345071 | 12/1989 | European Pat. Off. | 222/400.7 |
| 2192621 | 1/1988 | United Kingdom | 222/400.7 |

*Primary Examiner*—Michael S. Huppert
*Assistant Examiner*—Anthoula Pomrening
*Attorney, Agent, or Firm*—Klaas & Law

[57] ABSTRACT

An adapter for use with a tap assembly for dispensing a product from a container wherein the adapter has a body portion having separate product and gas passageways with an abutment ledge within the body portion surrounding the product passageway and having a sealing gasket seated thereon and connecting apparatus for connecting the adapter to the container. Dispensing apparatus is secured to the adapter and has a product passageway formed therein and has an abutment surface for contacting the sealing gasket to form a fluid tight seal between the abutment ledge and the abutment surface and wherein the adapter has two differing types of sealing apparatus for sealing the gas passageway wherein a first sealing apparatus is normally in a closed position and is automatically moved to an opened position when the adapter is connected to the container and a second sealing apparatus is normally in an opened position and is moved to a closed position by application of a force thereto.

18 Claims, 4 Drawing Sheets

ADAPTER FOR USE IN TAPPING A CONTAINER

FIELD OF THE INVENTION

This invention relates generally to apparatus for tapping a container to remove a fluid product therefrom and more particularly to an adapter for use with dispensing apparatus so that a fluid product may be removed from a container.

BACKGROUND OF THE INVENTION

There are many types of apparatuses presently in use for tapping a container to remove a fluid product therefrom, such as that illustrated in U.S. Pat. No. 4,000,829. One of the problems associated with this tapping apparatus is that it is not readily useable with different bar taps, one of which is a Sankey-type tap illustrated in U.S. Pat. No. 4,665,940 which is incorporated herein by reference thereto. Therefore, it is desirable to provide an adapter for use with containers having a sealing unit having integral first and second sealing plugs as described in U.S. Pat. No. 4,000,829, which is incorporated herein by reference thereto, so that any type of bar tap may be used with such containers. Such an adapter will enable the use of such containers in many differing establishments.

BRIEF DESCRIPTION OF THE INVENTION

This invention provides a tap adapter for use with a container provided with a sealing unit having integral first and second sealing plugs so that the fluid product in such container may be readily dispensed using any one of many differing types of bar taps.

In one preferred embodiment of the invention, there is provided an adapter for use with a tap assembly for dispensing a fluid product from a container which is provided with a sealing unit having integral first and second sealing plugs comprising a body portion having a product passageway and a separate gas passageway with the product passageway having an entrance portion facing toward the container and an exit portion facing away from the container. The gas passageway has an entrance portion facing away from the container and an exit portion facing toward the container. An abutment ledge projects inwardly into and surrounds the product passageway. Dispensing means are secured to the body portion and have a product passageway extending therethrough and a separate gas passageway. The dispensing means have an abutment portion. First sealing means are provided for forming a fluid tight seal between the body portion and the dispensing means when the dispensing means are secured on the body portion. Second sealing means are provided for forming a fluid tight seal between the body portion and the dispensing means around the product passageways therein and are seated on the abutment ledge. Securing means are provided for cooperating with the body portion for securing the dispensing means on the body portion. Connecting means are provided for connecting the body portion to the container so that the product may be dispensed from the container. The dispensing means particularly suited for use with the adapter of this invention comprises an outer portion having a longitudinal axis that has an end portion having radially outwardly projecting, circumferentially spaced apart cams that cooperate with lugs on the body portion to secure the dispensing means on the body portion and an inner portion having a longitudinal axis that is parallel to the longitudinal axis of the outer portion and which is mounted for axial movement relative to the outer portion. The first sealing means are located between the outer portion and the body portion to form a fluid tight seal therebetween. The inner portion has a product passageway that is aligned with the product passageway of the body portion when the dispensing means are secured to the body portion. The inner portion has an radially extending annular projection having a radially extending surface facing the first sealing means. The second sealing means are located between the radially extending surface of the inner portion and the abutment ledge of the body portion to provide the fluid tight seal therebetween. Third sealing means for sealing the gas passageway in the dispensing means and are movable between opened and closed positions. Fourth sealing means are provided for sealing the gas passageway in the body portion and are movable between opened and closed positions. In one embodiment, the fourth sealing means are resiliently urged toward the opened position and in another embodiment, the fourth sealing means are resiliently urged toward the closed position. A hollow product tube is secured to the product passageway in the body portion and a hollow gas tube is secured to the gas passageway in the body portion. The hollow product tube and hollow gas tube are dimensioned to be inserted through the first and second sealing plugs.

In one preferred mode of operation, the dispensing means are secured onto the body portion and the inner portion is moved so that the radially extending surface thereof is in contact with the first sealing means and exerts a pressure thereon so as to form the fluid tight seal between the radially extending surface and the abutment ledge. If there are no sealing means in the gas passageway in the body portion, gas will be escaping from the gas tube. If there are sealing means, they will be moved to the closed position to prevent the escape of the gas. The hollow product tube and the hollow gas tube are then inserted through the first and second sealing plugs and moved to a product dispensing position. In another preferred mode of operation, the dispensing means are secured onto the body portion with the radially extending surface of the inner portion out of contact with the second sealing means. The fourth sealing means are moved to the closed position and the hollow product tube and the hollow gas tube are inserted through the first and second sealing plugs and moved to the dispensing position. The fourth sealing means are released and they move to the opened position. Some of the product may move through the product passageway in the body portion but will be retained therein by the third sealing means and will return to the container through the gas passageway and gas tube. When it is desired to dispense product from the container, the radially extending surface of the inner portion is moved into contact with the second sealing means to connect the product passageways in the body portion and the inner portion. At the same time, a gas passageway in the dispensing means is connected to the gas passageway in the body portion so that gas under pressure may move into the container to force the product out through the product tube.

BRIEF DESCRIPTION OF THE DRAWINGS

Illustrative and presently preferred embodiments of the invention are shown in the accompanying drawings in which.

DETAILED DESCRIPTION OF THE INVENTION

Figure 1:
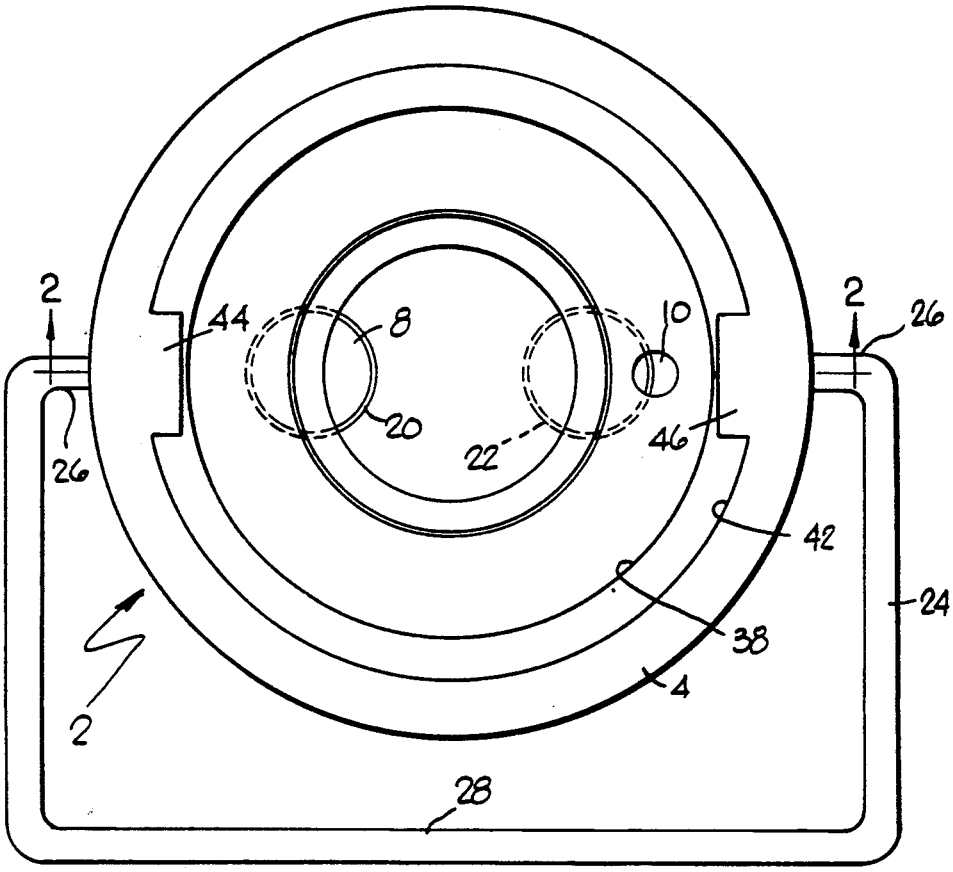
FIG. 1 is a top plan view of the adapter of this invention.
Figure 2:
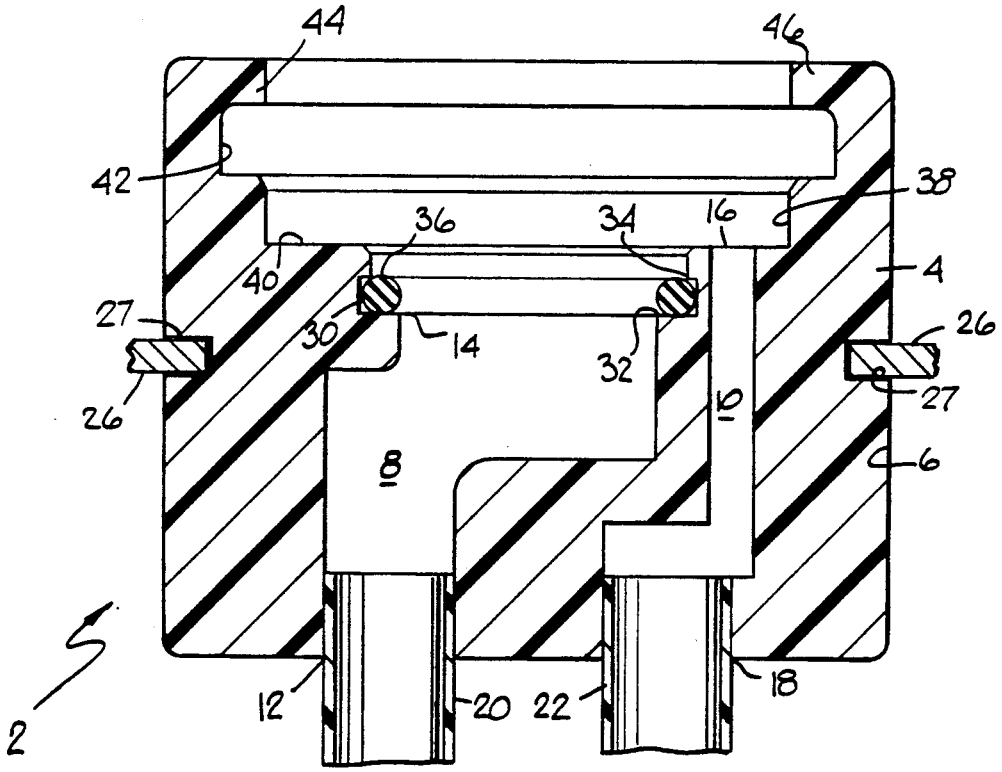
FIG. 2 is a cross-sectional view taken on the line 2—2 of FIG. 1.

In FIGS. 1 and 2, there is illustrated an adapter 2 for use with a tap assembly for dispensing product from a container (not shown). The adapter 2 has a body portion 4 having a cylindrical outer surface 6 and a longitudinal axis. The body portion has a product passageway 8 and a gas passageway 10. The product passageway 8 has an entrance portion 12 which faces the container when in the dispensing position and an exit portion 14 facing away from the container and adapted to be connected to dispensing means, as described below. The gas passageway 10 has an entrance portion 16 facing away from the container and adapted to be connected to a source of pressurized gas, such as carbon dioxide, as described below and an exit portion 18 facing the container when in the dispensing position. A hollow product tube 20 is secured in the entrance portion 12 by suitable means, such as an adhesive or welding, and a hollow gas tube 22 is secured in the exit portion 18 in a similar manner. The hollow product tube 20 has a length many times greater than the hollow gas tube 22 so that in the dispensing position, the end of the hollow product tube is next to the bottom of the container and the end of the hollow gas tube is next to the top of the container. A hold down wire bale 24 has end portions 26 which fit into opening 27 in the body portion 4 and has section 28 which fits under the conventional container neck ring (not shown) to prevent the adapter 2 from moving out of position on the container.

An radially outwardly extending annular groove 30 is formed in the body portion 4 and provides an abutment ledge 32 and a retaining lip 34. An 0-ring sealing gasket 36 is seated on the abutment ledge 32 and has an annular portion in the annular groove 30 and is retained in the annular groove 30 by the retaining lip 34. The body portion 4 has an inner cylindrical surface 38 next to the entrance portion 16 which has a diameter greater than the retaining lip 34 so as to form an abutment surface 40. The body portion 4 has another inner cylindrical surface 42 having a diameter greater than the diameter of the inner cylindrical surface 38 A pair of opposite lugs 44 and 46 project radially inwardly from the cylindrical surface 42 and form a portion of the securing means, as described below. The body portion 4, the hollow product tube 20 and the hollow gas tube 22 are integrally molded using a high molecular weight plastic, such as crystalline thermoplastic homopolymers made by the polymerization of formaldehyde marketed by DuPont under the designation Delrin or other materials having similar characteristics.

Figure 3:
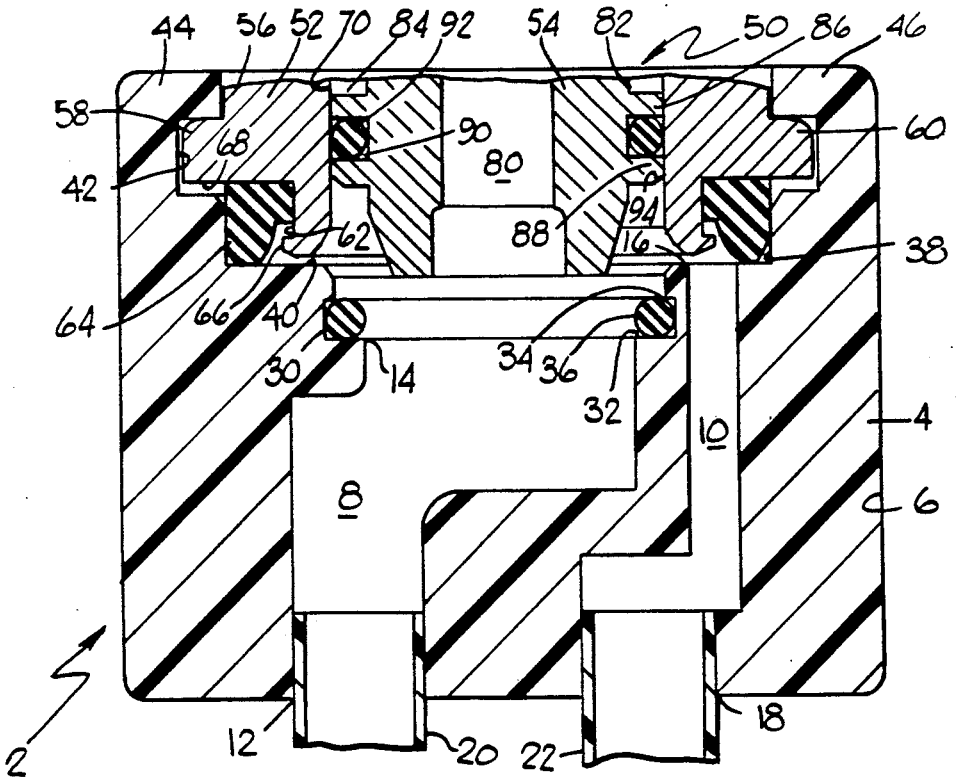
FIG. 3 is a cross-sectional view of a dispensing means in a non-dispensing position but secured to the adapter.
Figure 4:
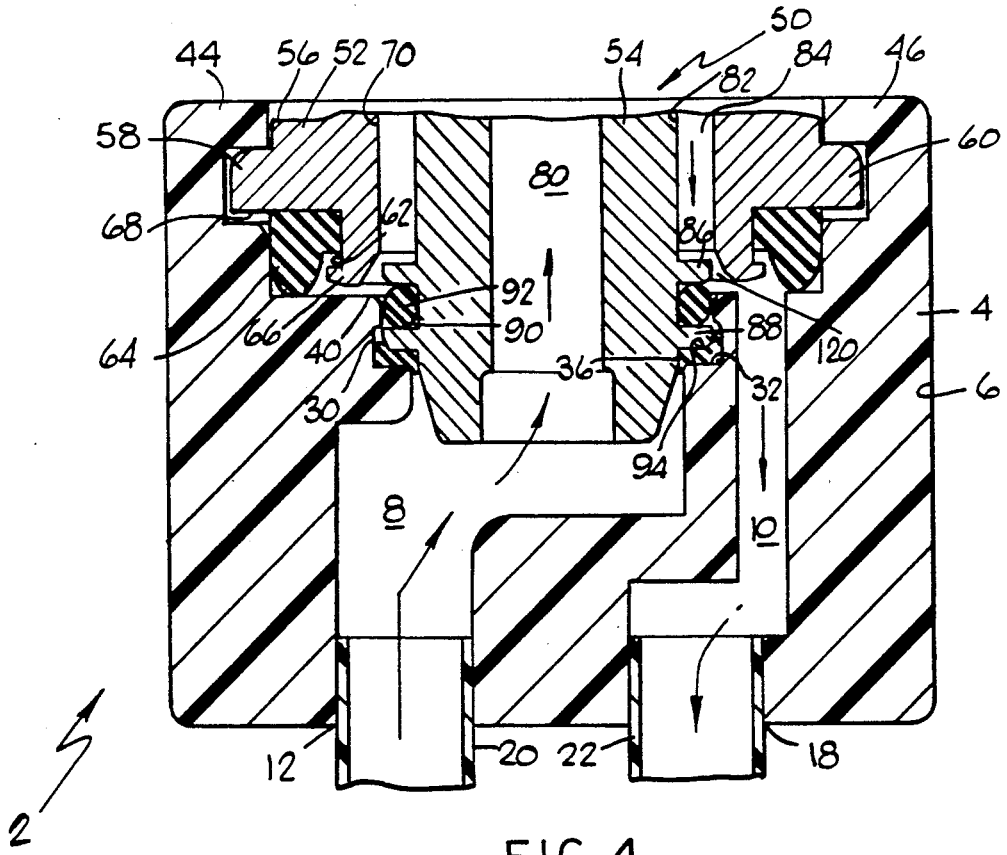
FIG. 4 is a cross-sectional view of the dispensing means in a dispensing position.

Dispensing means 50 are illustrated somewhat schematically in FIGS. 3 and 4 and may be of the Sankey-type tap assembly such as that marketed by Micromatic U.S.A., Inc., as model No. 24269-01. The dispensing means 50 has an outer portion 52 and an inner portion 54. The outer portion 52 has a generally cylindrical outer surface 56 and a pair of circumferentially spaced apart cams 58 and 60 which project radially outwardly from the outer surface 56. The spaces between the cam 58 and 60 each have an arcuate extent greater than the arcuate extent of the lugs 44 and 46 so that the outer portion 52 may be passed between the lugs 44 and 46 and rotated so that the cams 58 and 60 are beneath the lugs 44 and 46 to secure the outer portion 52 to the body portion 4. This arrangement is similar to that in U.S. Pat. No. 4,520,954 which is incorporated herein by reference thereto. The outer surface 56 has a radially inwardly extending annular groove 62 in which is seated an annular sealing gasket 64. As illustrated in FIGS. 3 and 4, when the outer portion 52 has been secured to the body portion 4, the bottom 66 of the outer portion 52 is spaced from the abutment surface 40. The annular sealing gasket 64 is in contact with and deformed between the abutment surface 40 and the radially extending surface 68 to form a fluid tight seal therebetween. The outer portion 52 also has a generally cylindrical inner surface 70.

The inner portion 54 has a product passageway 80 extending therethrough and a generally cylindrical outer surface 82 having a diameter less than the diameter of the generally cylindrical inner surface 70 so as to form an annular space 84 to provide a gas passageway therebetween. A pair of radially extending, axially spaced apart annular projections 86 and 88 are formed on the inner portion 54 to form an annular groove 90 in which is seated an 0-ring sealing gasket 92 to form a fluid tight seal between the outer portion 52 and the inner portion 54. The projection 88 has a radially extending surface 94 adapted to contact the 0-ring sealing gasket 36, as described below, to form a fluid tight seal between the inner portion 54 and the body portion 4.

Figure 5:
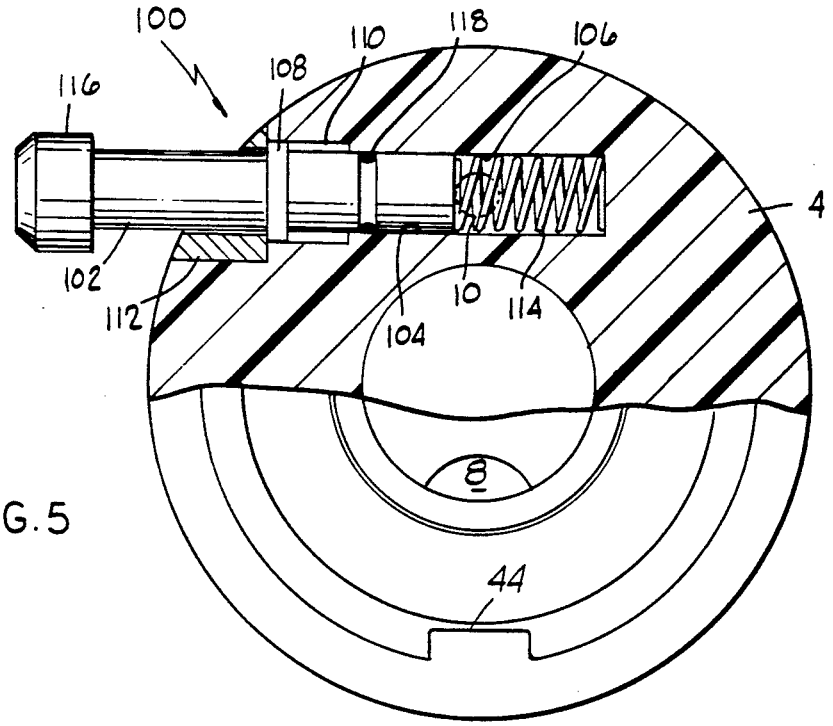
FIG. 5 is a cross-sectional view of a portion of FIG. 3 with sealing means for the gas passageway.

In FIG. 5, there is illustrated sealing means 100 for preventing flow of gas through the gas passageway 10. The sealing means 100 comprise a stem portion 102 movable between opened and closed positions and having a generally cylindrical outer surface 104 and is mounted for sliding movement in a generally cylindrical surface 106 in the body portion 4 which passes through the gas passageway 10. The stem portion 102 has a radially outwardly projecting flange portion 108 which moves in a recess 110 formed in the generally cylindrical passageway 106 which is closed by the member 112. Spring means 114 urge the stem portion 102 toward the opened position. A rounded head portion 116 is integral with the stem portion 102. When it is desired to close the gas passageway 10, a force is applied to the head portion 116 to move the stem portion 102 until the generally cylindrical outer surface 104 covers the gas passageway to form a gas tight seal. An 0-ring gasket 118 seated in a groove in the stem portion 102 provides a gas tight seal between the stem portion 102 and the cylindrical surface 106.

Figure 6:
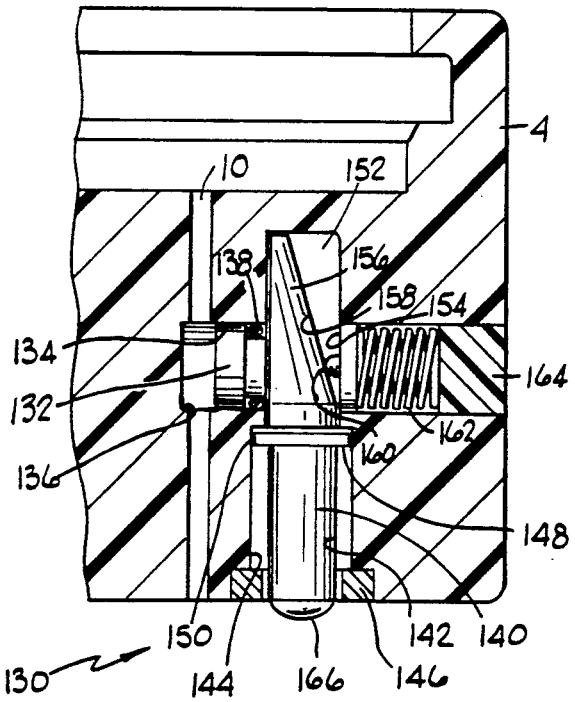
FIG. 6 is a cross-sectional view of another sealing means in the opened position for the gas passageway.
Figure 8:
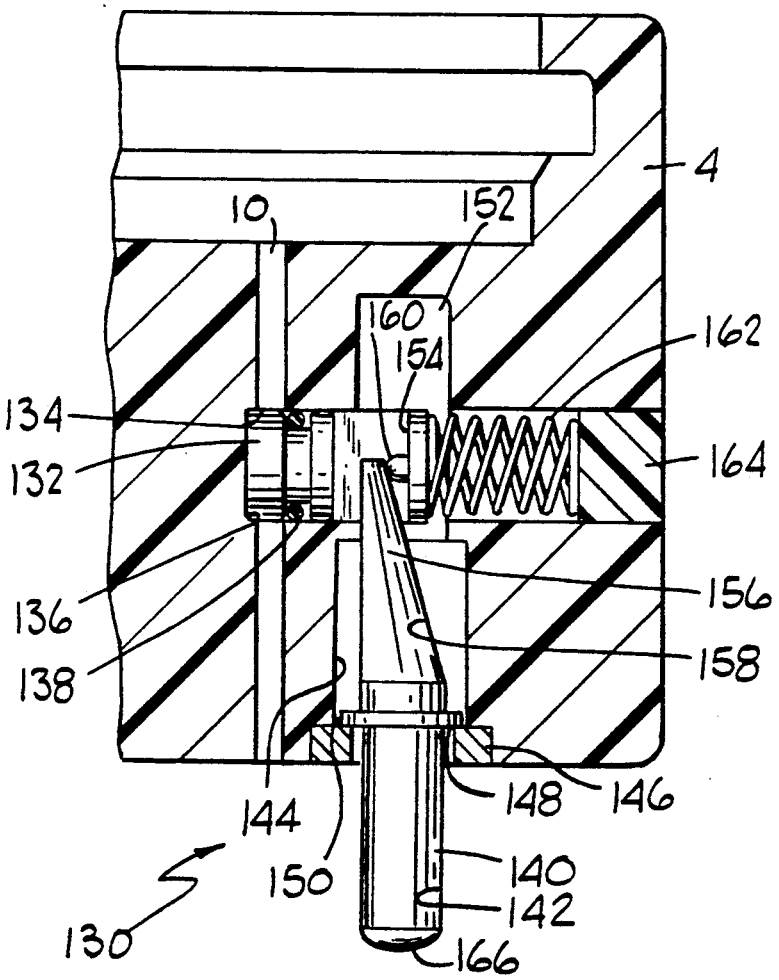
FIG. 8 is a view similar to FIG. 6 with the sealing means in a closed position.

In FIG. 6, there is illustrated another embodiment of sealing means 1 30 for preventing flow of gas through the gas passageway 10 in the opened position. The sealing means 130 comprises a stem portion 132 movable between closed and opened positions, normally resiliently urged to the closed position, and having a generally cylindrical outer surface 134 and is mounted for sliding movement in a generally cylindrical surface 136 in the body portion 4. An 0-ring gasket 138 forms a gas tight seal between the stem portion 132 and the generally cylindrical surface 136. The structure for moving the stem portion 132 comprises a plunger 140 having a generally cylindrical outer surface 142 mounted for movement over the generally cylindrical inner surface 144, which is partially closed by a closure member 146. A flange 148 having a generally cylindrical outer surface 150 is in contacting relationship with the inner surface 144 and functions to limit the sliding movement of the plunger 140. A slot 152 is formed in the body portion 4 and a corresponding slot 154 is formed in the stem portion 132. A member 156 extends from the flange 148 and passes through the slot 154 in the stem portion 132 and into the slot 152 in the body portion 4. The member 156 has an inclined surface 158. An integral projection 160 on the stem portion 132 is urged into contact with the inclined surface 158 by the spring 162. A closure member 164 holds the spring 162 in the body portion 4. As illustrated in FIG. 8, the integral projection 160 is urged by the spring 162 into contact with the inclined surface 158 so that a resulting force is applied to move the plunger downwardly until the flange 148 contacts the closure member 146. At the same time, since the integral projection 160 is now opposite to the smaller portion of the member 156, the stem portion 132 is in a position to close gas passageway 10. In operation, the stem portion 132 is urged into the closed position by the spring 162 so that the end portion 166 is spaced from the body portion 4. As the product tube 20 and gas tube 22 are pushed into the container, the head portion 166 contacts the container and is pushed upwardly to move the stem portion 132 to the opened position.

Figure 7:
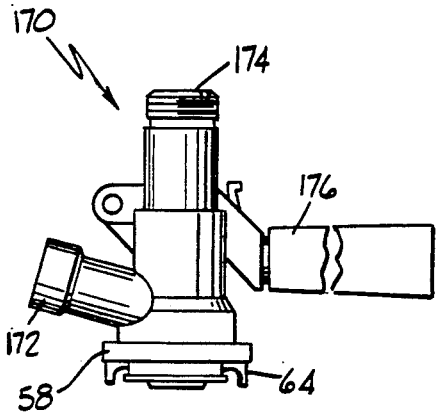
FIG.7 (PRIOR ART)
FIG. 7 is a side elevational view of a conventional tap assembly.

In FIG. 7, there is illustrated a conventional tap assembly 170 which can be used with the adapter 2 of this application. The tap assembly 170 has a $CO_2$ inlet 172, a product outlet 174, a cam 58 and a sealing gasket 64. A handle 176 operates conventional apparatus to move the inner portion 54 up or down.

In one preferred mode of operation, the outer portion 52 is moved through the lugs 44 and 46 and is rotated so that the cams 58 and 60 move under the lugs 44 and 46 to apply a force on the sealing gasket 64 to form a fluid tight seal between the outer portion 52 and the body portion 4. The inner portion 54 is moved by the handle 176 from the position illustrated in FIG. 3 to the position illustrated in FIG. 4 so that the surface 94 contacts the 0-ring sealing gasket 36 to deform the 0-ring sealing gasket 36 and form a fluid tight seal between the surface 94 and the abutment ledge 32. When the inner portion 54 has been moved to the position illustrated in FIG. 4, the annular projection 86 is spaced from the bottom 66 of the outer portion 52 so that a passageway 120 exists therebetween so that the gas passageway 84 is in fluid communication with the gas passageway 10. In the Sankey-type tap assembly described above, a supply of gas, such as carbon dioxide, under pressure is provided into the gas passageway 84 as soon as the inner portion 54 has been moved to the position illustrated in FIG. 4. If the tap adapter 2 does not have sealing means 100, then gas will flow out of the gas tube 22. If the tap adapter 2 has sealing means 100, a force is applied to the rounded head portion 116 to close the gas passageway 10 The product tube 20 and the gas tube 22 are inserted through the first and second sealing plugs and moved to a dispensing position at which the end of the product tube 20 is next to the bottom of the container and the end of the gas tube 22 is within the container and next to the top of the container.

In another preferred mode of operation, the outer portion 52 is secured to the body portion 4 as described above to the position illustrated in FIG. 3. The product tube 20 and the gas tube 22 are inserted through the first and second sealing plugs and moved toward the dispensing position. If the body portion 4 does not have sealing means 100, some product may spill out of the gas tube 22 since it is much shorter in length than the product tube 20. If the body portion 4 has sealing means 100, a force is applied to the rounded head portion 116 to close the gas passageway 10 to prevent spillage of the product from the container. After the gas tube 22 has been moved into the container, the force may be removed from the rounded head portion 116 and the spring means 114 will move the stem portion 102 to the opened position to return the assembly to an equilibrium condition. When it is desired to dispense product from the container, the inner portion 54 is moved by the handle 176 from the position illustrated in FIG. 3 to the position illustrated in FIG. 4 so that it can now function to dispense product from the container.

If the body portion 4 has the sealing means 130, the adapter 2 can be in the position illustrated in either of FIGS. 3 or 4 when the product tube 20 and the gas tube 22 are inserted into the container.

Although the dispensing means 50 have been described as having an outer portion 52 and a movable inner portion 54, it is possible to design it as one integral unit. In such integral unit, the cams 58 and 60 would be designed to move the dispensing means 50 to the position illustrated in FIG. 3 by one-half turn of the cams 58 and 60 and to the position illustrated in FIG. 4 by the second half turn of the cams 58 and 60.

It is contemplated that the inventive concepts herein described may be variously otherwise embodied and it is intended that the appended claims be construed to include the alternative embodiments of the invention except insofar as limited by the prior art.

What is claimed is:

1. An adapter for use with a tap assembly for dispensing a fluid product from a container which is provided with a sealing unit having integral first and second sealing plugs comprising:

a body portion having a product passageway and a separate gas passageway;

said product passageway having an entrance portion facing toward said container and an exit portion facing away from said container;

said gas passageway having an entrance portion facing away form said container and an exit portion facing toward said container;

dispensing means for dispensing said product from said container and having a product passageway and a gas passageway extending therethrough;

said dispensing means having a movable portion for movement between a dispensing position and a non-dispensing position;

first sealing means for forming a fluid tight seal between said body portion and said dispensing means;

securing means for securing said dispensing means to said body portion so that said product passageways are in fluid communication;

second sealing means for forming a fluid tight seal between said product passageways in said body portion and said dispensing means when said movable portion is in said dispensing position;

third sealing means for forming a fluid tight seal between said gas passageways in said dispensing means and said body portion when said movable portion is in said non-dispensing position but providing for fluid communication between said gas passageways in said dispensing means and said body portion when said movable portion is in said dispensing position; and connecting means for connecting said body portion to said container so that said product may be dispensed from said container.

2. The invention as in claim 1 and further comprising:

an annular abutment ledge projecting inwardly into said product passageway of said body portion;

said dispensing means having an abutment surface; and said second sealing means being in contact with said abutment ledge and said abutment surface.

3. The invention as in claim 2 and further comprising:

said body portion having an annular groove formed therein and having a portion of said second sealing means located therein when said second sealing means are seated on said abutment ledge.

4. The invention as in claim 1 wherein said connecting means comprise:

a hollow product tube secured in a sealed relationship to said product passageway at said entrance portion thereof;

a hollow gas tube secured in a sealed relationship to said gas passageway at said exit portion thereof; and said hollow product tube having a length greater than said hollow gas tube, which hollow product tube and hollow gas tube are dimensioned to be inserted through said first and second sealing plugs so that each of them has an opening in said container.

5. The invention as in claim 4 wherein:

said third sealing means being in said non-dispensing position before said hollow product tube and said hollow gas tube are inserted through said first and second sealing plugs; and moving means for moving said third sealing means to said dispensing position as said adapter is connected to said container.

6. The invention as in claim 1 and further comprising:

fourth sealing means for sealing said gas passageway in said body portion; and said fourth sealing means being movable between an opened position and a closed position.

7. The invention as in claim 6 wherein:

said fourth sealing means being in said closed position as said body portion is being connected to said container.

8. The invention as in claim 7 and further comprising:

resilient means for urging said fourth sealing means toward said closed position; and moving means for moving said fourth sealing means to said opened position as said body portion is connected to said container.

9. The invention as in claim 6 wherein:

said fourth sealing means being in an opened position before said body portion is connected to said container.

10. The invention as in claim 9 and further comprising:

resilient means for urging said fourth sealing means toward said opened position; and moving means for permitting movement of said fourth sealing means to said closed position as said body portion is being connected to said container.

11. An adapter for use with a tap assembly for dispensing a fluid product from a container which is provided with a sealing unit having integral first and second sealing plugs comprising:

a body portion having a product passageway and a separate gas passageway;

said product passageway having an entrance portion facing toward said container and an exit portion facing away from said container;

said gas passageway having an entrance portion facing away from said container and an exit portion facing toward said container;

dispensing means for dispensing said product from said container and having a product passageway extending therethrough;

first sealing means for forming a fluid tight seal between said body portion and said dispensing means;

securing means for securing said dispensing means to said body portion so that said product passageways are in fluid communication;

connecting means for connecting said body portion to said container so that said product may be dispensed from said container; and wherein said dispensing means comprises:

an outer portion having a longitudinal axis;

at least a portion of said securing means being located on said outer portion;

an inner portion having said product passageway extending therethrough and having a longitudinal axis parallel to said longitudinal axis of said outer portion;

said inner portion being mounted on said outer portion to permit axial movement of said inner portion relative to said outer portion;

said outer and inner portions being dimensioned so that an annular space exists therebetween; and additional sealing means for forming a fluid tight seal between said outer and inner portions.

12. An adapter for use with a tap assembly for dispensing a product from a container which is provided with a sealing unit having integral first and second sealing plugs comprising:

a body portion having a product passageway and a separate gas passageway;

said product passageway having an entrance portion facing toward said container and exit portion facing away from said container;

said gas passageway having an entrance portion facing away from said container and exit portion facing toward said container;

an annular abutment ledge projecting inwardly into said product passageway;

dispensing means secured to said body portion for dispensing said product from said container and having a product passageway extending and a gas passageway therethrough;

said dispensing means having a movable portion for movement between a dispensing position and a non-dispensing position;

securing means for securing said dispensing means on said body portion;

first sealing means for forming a fluid tight seal between said body portion and said dispensing means when said dispensing means are secured on said body portion;

said dispensing means having an abutment surface:

second sealing means for forming a fluid tight seal between said abutment ledge and said abutment surface when said movable portion is in said dispensing position;

third sealing means for forming a fluid tight seal between said gas passageways in said dispensing means and said body portion when said movable portion is in said non-dispensing position but providing for fluid communication between said gas passageways in said dispensing means and said body portion when said movable portion is in said dispensing position; and connecting means for connecting said body portion to said container so that said product may be dispensed from said container.

13. The invention as in claim 12 wherein said dispensing means comprises:

an outer portion having a longitudinal axis;

at least a portion of said securing means being located on said outer portion;

an inner portion having said product passageway extending therethrough and having a longitudinal axis parallel to said longitudinal axis of said outer portion;

said inner portion being mounted on said outer portion to permit axial movement of said inner portion relative to said outer portion;

said inner portion mounted on said outer portion so that an annular space is formed therebetween; and said third sealing means for forming a fluid tight seal between said outer and inner portions.

14. The invention as in claim 13 and further comprising:

said annular space providing a gas passageway for said dispensing means which gas passageway is separate from said product passageway; and said third sealing means preventing fluid communication between said gas passageways in said body portion and said dispensing means when said body portion is being connected to said container.

15. The invention as in claim 13 and further comprising:

moving means for moving said inner portion in said axial direction to move said abutment surface into contact with said second sealing means to provide a fluid tight seal between said abutment surface and said abutment ledge.

16. The invention as in claim 15 wherein:

said movement of said inner portion moves said third sealing means out of sealing relationship with said outer and inner portions so that said gas passageways in said dispensing means and said body portion are in fluid communication.

17. The invention as in claim 16 wherein said connecting means comprises:

a hollow product tube secured in a sealed relationship to said product passageway at said entrance portion thereof;

a hollow gas tube secured in a sealed relationship to said gas passageway at said exit portion thereof;

said hollow product tube having a length greater than said hollow gas tube, which hollow product tube and hollow gas tube are dimensioned to be inserted through said first and second sealing plugs so that each of them as has an opening in said container.

18. The invention as in claim 17 and further comprising:

said body portion having an annular groove formed therein and having a portion of said second sealing means located therein when said second sealing means are seated on said abutment ledge; and holding means on said body portion to prevent movement of said body portion from its location on said container.

* * * * *